United States Patent [19]

Fox

[11] 4,007,677

[45] Feb. 15, 1977

[54] COMPACTOR DEVICE

[76] Inventor: Anthony Fox, 8306 Queen Ave. South, Minneapolis, Minn. 55431

[22] Filed: May 22, 1975

[21] Appl. No.: 579,783

[52] U.S. Cl. ..... 100/45; 100/49; 100/53; 100/215; 100/218; 100/245; 100/255; 100/269 R; 53/124 B

[51] Int. Cl.[2] ..... B30B 15/18

[58] Field of Search ..... 100/45, 49, 52, 53, 100/215, 218, 240, 245, 269 R, 232, 255; 53/124 B

[56] References Cited

UNITED STATES PATENTS

| | | | |
|---|---|---|---|
| 2,355,675 | 8/1944 | Pryor et al. | 100/232 X |
| 2,780,989 | 2/1957 | Guy | 100/215 X |
| 3,141,401 | 7/1964 | Lindemann et al. | 100/232 X |
| 3,231,107 | 1/1966 | Clar | 100/49 |
| 3,424,078 | 1/1969 | Boyd et al. | 100/49 |
| 3,501,890 | 3/1970 | Hunt | 100/218 |
| 3,580,166 | 5/1971 | Longo | 100/49 |
| 3,608,476 | 9/1971 | Price et al. | 100/49 X |
| 3,722,403 | 3/1973 | Longo | 100/218 X |
| 3,754,501 | 8/1973 | Horn | 100/215 X |
| 3,908,538 | 9/1975 | Boyd | 100/215 |

FOREIGN PATENTS OR APPLICATIONS

| | | | |
|---|---|---|---|
| 1,201,391 | 8/1970 | United Kingdom | 100/45 |

*Primary Examiner*—Billy J. Wilhite
*Attorney, Agent, or Firm*—Orrin M. Haugen

[57] ABSTRACT

A waste compacting system for use in commerical establishments is described. Refuse to be compacted is fed via a chute into a first chamber and when a given level is reached, a first hydraulically actuated ram is automatically or manually activated to push the refuse from the collecting chamber into a compacting chamber. A second hydraulically actuated ram or platen then operates to apply a high compaction force to the refuse, forcing it into a container in the bottom of the compaction chamber. An electrical control network which includes various interlocks insures safe and reliable operation of the system.

1 Claim, 2 Drawing Figures

COMPACTOR DEVICE

BACKGROUND OF THE INVENTION

This invention relates generally to trash compacting apparatus, and more specifically to an improved compaction system whereby refuse fed into a chute from various floors of a multi-story building is used to automatically cycle the system to thereby compact it in a container for easy disposal thereof.

Many forms of trash compactor devices are known in the art. In general, they include means for collecting the trash in a chamber located beneath or to one side of a movable platen. When the platen is activated, it enters the chamber and applies a relatively high force to the trash to thereby reduce its volume and store it in a container. Many of these devices are manually operated and require almost continuous operator attention to load the unit with loose waste, operate the unit and unload the compacted waste. While other prior art devices are automatic or semi-automatic in nature, they have not been altogether commercially successful because of inherent problems in reliability in the design thereof. In normal use in a wide variety of commercial establishments, trash compactors of the type described herein are subjected to a wide variety of refuse including paper, cardboard, cans, bottles, lumber, wire, etc. While certain of the prior art arrangements operate satisfactorily on such things as paper and cardboard, they are generally unable to handle and dispose of many of the other items of trash normally encountered.

SUMMARY OF THE INVENTION

In accordance with the teachings of the present invention, there is provided a compactor design which has proved, under a wide variety of testing, to be readily suitable for general commercial utilization. The compactor is designed to be installed in the basement of a multi-story building, directly beneath a trash disposal chute such that refuse deposited in the chute falls into a collection chamber, whose floor is horizontally movable. When the level of refuse in the collection chamber reaches a predetermined level, a suitable sensor detects this condition and activates an electro-hydraulic control system. As a first step in the automatic cycle of operation, the floor of the collection chamber is withdrawn by means of a hydraulic ram and the collected trash falls into a second chamber located immediately below the collection chamber. The aforementioned hydraulic ram then operates to push the deposited trash from the second chamber into a third compaction chamber. A suitable container such as a polyethylene bag, a box, or a specially designed basket is located in the bottom of the compaction chamber and receives the loose material shoved into it during the second stroke of the hydraulic ram. As a third step, a second hydraulic ram is activated causing a platen to descend into the compaction chamber and apply a relatively high compression force to the material deposited in the collection device. Following the downward stroke of the platen, it again rises to its normal rest position and the system shuts off until such time that the first collection chamber again receives a predetermined level of loose refuse, causing the aforementioned cycle to again be repeated. After several cycles, the container located in the compaction chamber becomes full and this condition is sensed to activate an alarm which notifies an operator that the container is full and must be unloaded. The operator opens the collection compartment access door and depresses an eject button. This brings into play still a third hydraulic ram which applies a horizontal force to the container of compacted waste and shoves it out of the unit onto a suitable cart.

It is accordingly a principal object of the present invention to provide an improved waste compaction device.

Still another object of the invention is to provide a waste compaction device which is automatic in operation and which requires a minimum of operator attention.

It is yet a further object of the present invention to provide a waste compaction device of rugged construction which operates reliably over long periods of normal use.

It is yet a further object of the present invention to provide a novel electrical control system for a waste compactor.

Other and further objects of the present invention will become apparent to those skilled in the art upon a study of the following specification, appended claims, and accompanying drawings.

DESCRIPTION OF THE PREFERRED EMBODIMENT

Figure 1:
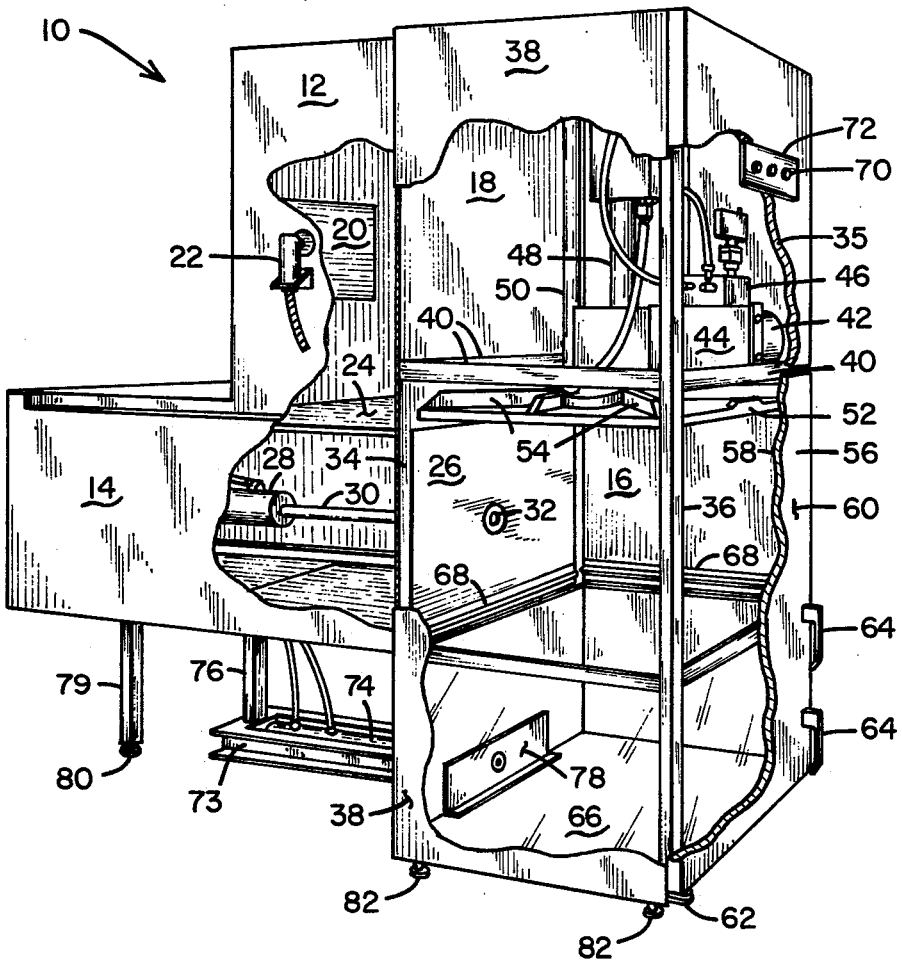
FIG. 1 is a perspective drawing of the preferred embodiment which has been partially sectioned to reveal the operating components thereof.

Referring first to FIG. 1, there is shown generally by numeral 10 the mechanical structure of the preferred embodiment. The cabinet may be considered as being comprised of four separate chambers, namely the collection chamber 12, the loading chamber 14, the compaction chamber 16, and the controls housing 18. The collection chamber 12 is opened at its top, is generally rectangular in cross-section, and may have, for example, a length of 33 inches and a width of 20 inches. The four side walls defining the chamber 12 may be formed from aluminum plate so as to facilitate easy cleaning and maintenance. When installed in a building, the collection chamber 12 is located directly below the waste disposal chute in the building and is preferably fastened thereto by welding or other suitable means. A small hinged door 20 is located in the rear wall of the chamber 12 to permit operator access for inspection and cleaning purposes.

Mounted on the outside of the left wall of the chamber 12 is an "electric eye" control 22 which includes a light source and a photocell along with a time delay circuit, the details of which are not illustrated in FIG. 1. Disposed immediately across the collection chamber 12 on the inside surface of the right wall thereof is a polished reflector which is focused to direct the light projected from the electric eye unit 22 onto the surface of the photocell also contained in the unit 22. The combination of the electric eye and associated reflector is positioned a predetermined distance above the floor 24 of the collection chamber 12. As trash is deposited and flutters past the photocell unit 22, the time delay network incorporated therein prevents the system from becoming actuated. It is only when the reflected light beam is interrupted for a prolonged and predetermined period of time that system actuation will occur. Thus, it is only when the level of material deposited in the collection chamber 12 rises to the point where the beam is blocked that actuation will occur.

The floor 24 of the collection chamber 12 is integrally formed with or connected to the vertical movable plate 26 which, when in the position illustrated, forms the rear wall of the compaction chamber 16. A hydraulic cylinder 28 is mounted within the loading chamber 14 in a horizontal plane and has its piston rod 30 bolted to the vertical plate member 26 at point 32 and its cylinder portion secured to the rear wall of chamber 14. When the unit is cycled, the piston rod 30 is withdrawn into the cylinder 28 which draws the plate 26 rearward to a point generally in alignment with the rear surface of the collection chamber 12. Of course, since the floor plate 24 of the collection chamber 12 is connected to the plate 26, it too moves rearward allowing the accumulated trash in the collection chamber 12 to fall downward into the chamber 14. At this point, the plate 26 serves as the rear wall of the loading chamber 14. Subsequently, the hydraulic controls operate to cause the piston rod 30 to again move out from the cylinder 28 to push the trash now located in the feed chamber 14 into the compaction chamber 16.

In the preferred embodiment, the floor plate 24 of the collection chamber 12 is formed from ½-inch steel plate to resist any damage from heavy, free-falling objects. It has been found desirable also to provide a polyvinyl chloride plastic lining to the entire collection chamber 12 to deaden impact sounds of falling objects.

While not specifically illustrated in the drawing of FIG. 1, there is located immediately behind the rear wall 34 of the compaction chamber and substantially aligned with the upper edge of plate 26, a ½-inch steel sharkstooth shear bar which serves to cut off elongated waste such as broom handles, 2 × 4's, etc., reducing it to the proper size for the compaction chamber 16.

The cabinet walls comprising the equipment housing 18 and the compaction chamber 16 may be in the form of an inner skin 35 made from 14-gauge cold rolled steel plate welded to four vertical angle iron corner struts 36, only one of which is illustrated. An outer decorative skin 38 which may be formed from 18-gauge cold rolled steel may also be welded to the vertical supports and to the edges of the inner skin 35 to form an extremely rugged cabinet construction. Horizontal steel angle bars 40 are welded to the inside surface of the inner-most skins 35 forming the controls housing 18 and these angle members 40, in turn, support a floor plate (now shown) for the chamber 18 on which is mounted an electric motor 42, a hydraulic pump 44, and associated hydraulic control valves 46. Passing through apertures provided in the floor plate is the piston rod (not shown) of a vertically oriented hydraulic cylinder 48. Also passing through the floor plate supported by the angle bars 40 are a pair of vertical guide members 50 which are disposed on either side of the cylinder 48 and displaced therefrom a predetermined distance. These guide members pass through bearings (not shown) in the floor plate and serve to maintain the compaction platen 52 in a horizontal plane during its operation.

More specifically, the platen 52 is connected to the end of the piston rod of the hydraulic cylinder 48 and the ends of the two guide members 50 are also secured to the upper surface of the platen 52. The platen 52, in the preferred embodiment, is formed from heavy aluminum plate and is provided with ribs 54 on the upper surface thereof to increase the rigidity thereof and to prevent deformation during the compaction stroke.

The front face of the compaction chamber 16 is provided with an access door 56 also formed from two layers of cold rolled steel, the inner layer 58 preferably being formed from 11-gauge cold rolled steel and the outer skin or layer 60 being 18-gauge cold rolled steel. The access door 56 is provided with hinge pins (not shown) at the lefthand edge of the top and bottom thereof which cooperate with hinge plates 62 welded to the cabinet skins as illustrated. A pair of handles 64 are provided at the lower righthand edge of the access door 56, these door handles being connected to a pressure relieving lock which prevents the access door from being forced open rapidly when the latches are initially released.

Contained within the compaction chamber 16 and resting on the floor thereof is a suitable collecting basket 66, here illustrated as being formed from a transparent plastic so that the internal construction of the cabinet can be observed. Rather than employing a special basket, it is possible to use a cardboard box of the appropriate dimension or even a polyethylene bag as a waste container.

Located immediately above the rim of the container 66 are narrow steel plates 68 which are welded to the inner surface of the interior skins 35 defining the chamber and which have a lip of triangular cross-section projecting outwardly therefrom. The plates 68 prevent refuse from being forced between the outside surfaces of the container 66 and the inside surfaces of the cabinet to thereby prevent the container from becoming wedged within the chamber.

As will be more fully explained when the details of the operation of the compactor are described, after the cylinder 28 has been operated to push the loose refuse into the compaction chamber, the cylinder 48 is operated to force the platen 52 downward, compacting the refuse into the container 66.

Located directly beneath the chamber 14 and resting on the ground is a frame 73 formed from "I"-channel which is dimensioned to surround and protect a third hydraulic cylinder 74. As such, the channel 73 generally defines a "U"-shape and the right-most ends thereof are welded to the outer skin of the rear wall of the compaction chamber 16. The base of the U-shaped channel 73 rests upon the ground and a vertical strut 76 is welded to it and to the base of the compartment 14. The piston rod of the hydraulic cylinder 74 passes through a hole in the exterior and interior skins forming the rear of the compartment 16 and is connected to an angle plate 78. The lower edge of the container 66 rests upon the horizontal extending portion of the angle 78 such that when the cylinder 74 is actuated, the basket or container 66 is shoved out of the compaction chamber 16 through the opened access door 56.

Now that the specifics of the mechanical construction of the compactor device have been described in detail, consideration will next be given to the electrical control circuitry incorporated in the system for cycling the hydraulic actuators in a desired sequence.

Figure 2:
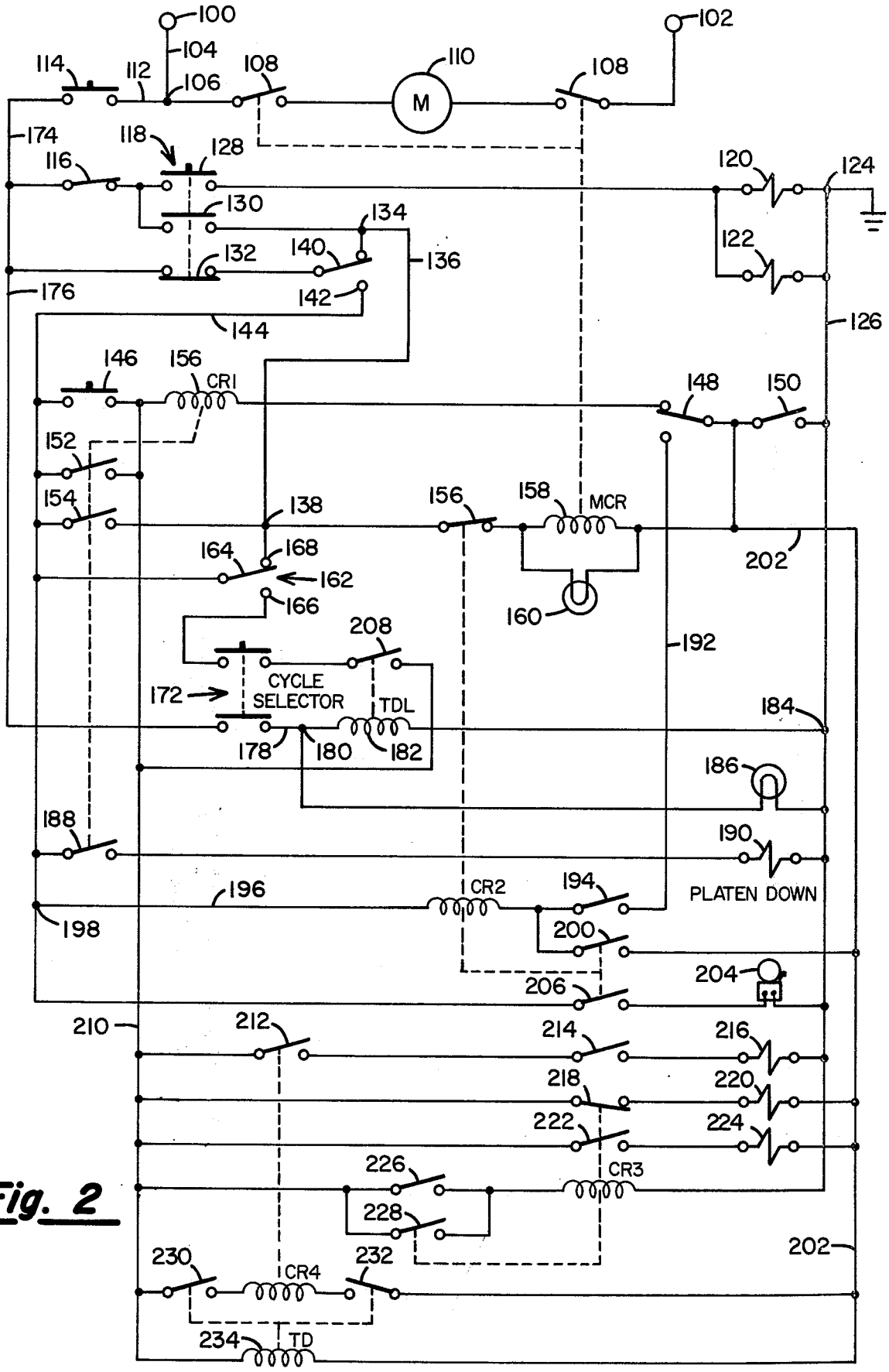
FIG. 2 is an electrical schematic diagram of the control circuitry employed in the embodiment of FIG. 1

Referring now to FIG. 2, there is shown an electrical schematic diagram of the control circuits embodied in the compactor of FIG. 1. For the most part, the electrical control circuits as well as the various hydraulic pumps and controls are located in the control housing 18. Because of the enclosed construction of this housing 18, the controls remain free from contamination from dust and the like.

As is shown in FIG. 2, first and second terminals 100 and 102 are adapted to be connected across a source of alternating current voltage. Terminal 100 is connected by a conductor 104 to a junction point 106. Connected in a series circuit between the junction point 106 and the AC line terminal 102 is a combination of a pair of motor control relay contacts 108 and a hydraulic pump motor 110. The motor 110, identified by numeral 42 in FIG. 1, may comprise a one-horsepower unit operating at 3450 revolutions per minute and is used to drive a two-stage hydraulic double pump 44 which is capable of delivering, for example, 6 gallons per minute of hydraulic fluid.

Also connected to the junction point 106 is a conductor 112 in which is disposed an "on-off" key operated switch 114. The key switch 114 is shown in its open position, but when it is operated, the contacts close and line voltage is applied to a first pole of a single polesingle throw limit switch 116. The limit switch 116 is associated with the service door 56 and is closed only when door 56 is open. The other terminal of the limit switch 116 is adapted to be connected through contacts on a manually operable eject switch 118 to first terminals of first and second solenoid operated hydraulic valves 120 and 122. The remaining terminals of these two solenoid operated valves are connected at junction 124 to a grounded bus 126.

The manually operable eject switch 118 has a pair of normally open contacts 128 and 130 and a single set of normally closed contacts 132. One of the set of contacts 130 is connected to a junction point 134 and a conductor 136 connects that point to still another junction point 138. A single pole-double throw limit switch associated with the piston rod of the ejector cylinder 74 (FIG. 1) has one terminal connected to the junction point 134 and a second terminal connected to one of the normally closed contacts in set 132 of the eject switch 118. When the piston of the ejector cylinder 74 is fully retracted, the limit switch is in the position illustrated. However, when the piston is extended to shove the container 66 out from the compaction chamber, the limit switch 140 makes contact with the terminal 142 on the power bus 144.

Connected in series between the power bus 144 and the ground bus 126 is an on-off manually operable pushbutton switch 146 termed the "cycle start" switch, a first relay coil CR1, a pressure operated single polesingle throw switch 148, and a normally open safety switch 150. As long as the safety switch 150 is open, the control circuitry remains disabled.

Connected in parallel with the cycle-start pushbutton 146 is a set of contacts 152 which are normally open, but which close when the relay coil CR1 is energized. Connected between the power bus 144 and the junction point 138 is a second set of normally open contacts 154 also associated with and operated by the relay coil CR1. Connected between the junction point 138 and the ground bus 126 is a series combination of a set of normally closed relay operated contacts 156, the coil of the motor control relay 158, and the aforementioned normally opened safety switch contacts 150. When energized, the motor control relay 158 operates to close the normally open contacts 108 which are connected in series with the hydraulic pump motor 110 an the AC supply. An indicator lamp 160 is connected in parallel with the motor control relay 158 and provides a visual indication to the operator that the hydraulic pump motor 110 is being energized.

Also connected between the power bus 144 and the junction point 138 is a single pole-double throw limit switch 162 which is associated with the platen 52 (FIG. 1) and when the platen is in its fully retracted upper position, the arm 164 of the switch 162 is in contact with terminal 166. However, as the platen moves downward, the arm 164 abuts the contact 168.

Terminal 166 is connected by conductor 170 to a four pole toggle switch 172 termed the "cycle selector" switch. As will be more fully set forth this switch allows the operator to have the compactor unit run in an automatic mode or in a manual mode. When the switch 172 is in the position indicated by the solid line in FIG. 2, the system must be manually cycled by depressing the cycle-start button 146. However, when the toggle switch 172 is switched to the position indicated by the dotted line, the system will operate in the automatic mode under control of the level sensing photocell 22 (FIG. 1).

When the cycle selector switch 172 is in its automatic mode, when the key switch 114 is turned to the on position, power will be applied via terminal 100, conductor 112, switch 114, conductor 174, conductor 176, and a conductor 178 to a first terminal 180 of the photocell-operated time delay relay coil 182. The other terminal of this relay is connected to the ground bus 126 at junction 184. Connected directly in parallel with the time delay relay 182 is the lamp 186 located in the "electric-eye" unit 22 for producing the requisite light beam for the photocell system.

Connected in series between the power bus 144 and the ground bus 126 is a series combination of normally open contacts 188 operated by the relay CR1 and the winding of a solenoid operated valve 190 associated with the hydraulic cylinder 48 controlling the vertical movement of the platen. When the solenoid winding 190 is energized, the hydraulic valve associated with the cylinder 48 directs the flow of hydraulic fluid into the cylinder causing the platen to move downward.

The normally open contact of the pressure switch 148 is connected by a conductor 192 to one terminal of still another limit switch 194 which is normally open, but which closes when the container 66 becomes filled with compacted waste. Connected to the other terminal of the limit switch 194 is a relay coil CR2 whose other terminal is connected by a conductor 196 to a junction 198 on the power bus 144. A set of normally open contacts 200 is disposed between the first terminal of the relay winding CR2 and an auxiliary bus 202 which is normally at ground potential so long as the safety switch 150 is closed.

A series circuit comprised of an audible alarm 204 and a set of normally open contacts 206 is connected between the power bus 144 and the ground bus 126. When the relay coil CR2 is energized, the contacts 206 will be closed to provide energization to the alarm 204.

Proceeding with a description of the various components and interconnections of the control circuits, when the cycle selector switch 172 is in its automatic position as previously described, and the limit switch 162 has its arm 164 contacting terminal 166, when the time delay relay 182 becomes de-energized because of a build-up of trash in the collection chamber 12, the contacts 208 operated by the time delay relay 182 close and the line potential is applied by way of the power bus 144, the limit switch 162, the conductor 170, and the now-closed contacts 208 to the bus 210. Stated otherwise, the bus 210 will be "hot" with respect to ground when the platen is in its fully elevated position, the cycle selector switch 172 is in its automatic position and the light beam associated with the time delay relay photocell is broken for a prescribed length of time.

Connected in series between the bus 210 and the ground bus 126 is a series circuit comprising a set of normally open contacts 212, a limit switch 214, and the solenoid winding of a hydraulic check valve 216. The contacts 212 are operated by a relay CR4, yet to be described. When the piston rod 30 of the hydraulic cylinder 28 (FIG. 1) is in its forward position as illustrated in FIG. 1, the switch contacts 214 will be closed.

Connected in series between the bus 210 and the bus 202 is a series combination of a set of normally closed relay operated contacts 218 and a solenoid winding 220 associated with the hydraulic cylinder 28. When the winding 220 is energized, the solenoid operated valve permits hydraulic fluid to enter the cylinder 28 to cause the piston rod 30 to be retracted. Also connected in series between the bus 210 and the bus 202 is a set of normally open relay operated contacts 222 and a solenoid winding 224. When the winding 224 is energized, the hydraulic fluid from the motor driven hydraulic pump is directed into the cylinder 28 (FIG. 1) to cause the piston rod 30 to be forced out from the cylinder. The contacts 218 and 222 are controlled by the relay winding CR3 which is connected in series with a limit switch 226 between the bus 210 and the ground bus 126. The limit switch 226 is operated by the positioning of the push plate 26 (FIG. 1) and will be closed when the piston rod 30 is fully retracted within the cylinder 28. Bridging the limit switch 226 is a set of normally open contacts 228 also controlled by the energization of the relay winding CR3.

The relay winding CR4 which controls the contacts 212 is connected in series with a pair of normally open contacts 230 and 232 between the bus 210 and the bus 202. Bridging the series circuit including relay winding CR4 and the contacts 230 and 232 is a time delay relay coil 234. The purpose of the relay 234 is to allow the push plate 26 to get off the limit switch 226, as will be more further explained when the operation of the system is considered.

This completes a description of the various circuit interconnections of the control network utilized in the compactor device of the present invention. Consideration will now be given to the mode of operation.

OPERATION

Let it first be assumed that the compactor device is in its standby condition wherein AC power is applied across the input terminals 100 and 102, the piston 30 is extended so that the push plate 26 forms the rear wall of the compaction chamber 16 and the floor plate 24 forms the base of the collection chamber 12. Under the assumed conditions, the limit switch 214 is closed and the limit switch 226 is open. Assume further that the container 66 is not full so that the limit switch 194 is open. Also, the platen is in its raised position as illustrated in FIG. 1 and, as such, the arm 164 of the limit switch 162 is abutting terminal 166. Also, in the standby condition, the ejector piston rod is retracted into the cylinder 74, causing the limit switch arm 140 to abut contact 142.

As small quantities of trash are deposited into the collection chamber 12 and flow past the beam emitted by the photocell unit 22, nothing will happen in that the photocell unit will not react to momentary disruptions of the reflected light beam. However, as the level of waste material builds up in the collection chamber 12, the reflected light beam will be broken for an extended period of time sufficient to trigger the photocell unit. More specifically, the photocell operated time delay relay 182 will become de-energized, causing the contacts 208 associated therewith to close. The closure of contacts 208 causes a circuit to be established from the terminal 100 to conductor 112, through the closed on-off key operated switch 114, through conductor 174, through the normally closed contacts 132 of the ejector switch 118, through the ejector limit switch 140 and conductor 114, through the limit switch arm 164 and conductor 170, through the contacts of the cycle selector switch 172 and the now-closed contacts 208 to the bus 210. When bus 210 is hot with respect to ground, the relay winding CR1 will be energized through the pressure sensing switch 148 and the closed safety switch contacts 150 to the ground bus 126.

Energization of relay winding CR1 closes contacts 152 to latch the relay winding CR1 between the power bus 144 and the ground bus 126. The contacts 154 also close under control of relay winding CR1. Because at this time relay CR2 is de-energized, the contacts 156 will be closed and accordingly, the motor control relay 158 will be energized.

The energization of the motor control relay 158 causes the normally open contacts 108 to close and connects the hydraulic pump motor 110 across the AC terminals 100 and 102. Hydraulic fluid under pressure flows through suitable high pressure hoses to the hydraulic cylinder 28, and since the solenoid 220 is energized (bus 210 is hot with respect to ground bus 126), the piston rod 30 is retracted into the cylinder 28 drawing the push plates 26 and the floor plate 24 rearward. The accumulated trash in chamber 12 therefore drops into the loading chamber 14 between the now-retracted push plate 26 and the opening now existing between the fill chamber 14 and the compaction chamber 16.

When the push plate 26 reaches its fully retracted position, the "ram back" limit switch 226 closes to complete a circuit through relay winding CR3, energizing it, and causing the contacts 218 in series with the solenoid 220 to open. At the same time, the normally open contacts 222 become closed to energize the "ram forward" solenoid 224. Energization of this last-mentioned solenoid steers the hydraulic fluid into the cylinder in such a fashion that the piston rod 30 now moves to the forward position, pushing the accumulated trash into the compaction chamber 16. Any elongated refuse which is over-sized as far as the opening into the compaction chamber is concerned, is forced against the sharks-tooth cutting bar (not shown) and cut to a size which will pass through the opening.

During the interval that the piston rod 30 was being retracted and then again extended, the solenoid 190 was also energized because the normally open contacts 188 associated with relay winding CR1 were closed. The solenoid 190 operates a valve in the hydraulic cylinder 48 to cause hydraulic fluid to enter the cylinder and force the platen 52 downward. Thus, the platen began its descent upon energization of the relay winding CR1 and the excitation of the hydraulic pump motor 110. The rate of descent of the platen is substantially less than the rearward and forward stroke of the piston 30 so that by the time the refuse is pushed into the compaction chamber 16, the platen 52 is still above the level of the refuse in its uncompacted state.

When the compaction force of the platen on the waste material exceeds a pre-set value, the pressure switch 148 opens, breaking the circuit through the relay coil CR1 and connecting the ground bus 126 to the conductor 192 by way of the closed safety switch 150. The de-energization of relay winding CR1 unlatches the cycle-start switch 146 and opens the contacts 154, but because the platen is no longer in its upper-most position, the upper limit switch 162 will be in a position whereby terminal 164 touches terminal 168. As such, the motor control relay 158 will remain energized. The solenoid 190, however, becomes de-energized because the contacts 188 associated with relay CR1 become open. This allows the platen to again assume its raised position,. When the contacts 152 re-open upon de-enegization of the relay winding CR1, the relay CR3 becomes de-energized in that the power bus 144 is no longer connected to the auxiliary bus 210. De-energization of the relay winding CR3 opens contacts 228, unlatching the relay winding CR3.

When the platen 52 again assumes its raised position, the contacts of the pressure switch 148 again revert to their closed position, i.e. the position illustrated in FIG. 2. When the platen reaches its fully raised position, the upper limit switch 162 opens, breaking the circuit to the motor control relay 158 and turning off the motor. At this point, the system is again in its standby condition.

If after several cycles of compaction, the container 66 becomes full, the "full-warning" limit switch 194 closes and during the point in the cycle where the pressure switch 148 operates to connect the ground bus 126 to the conductor 192, relay CR2 will be energized, causing contacts 200 to close and thereby latch the relay winding CR2 between the power bus 144 and the grounded bus 202. The simultaneous closure of contacts 206 associated with the relay winding CR2 will cause the audible alarm device 204 to operate. The operator is thus informed that the unit must be emptied.

To accomplish this, the operator opens the service door 56 which causes the service door limit switch 116 to close and he manually depresses the eject switch 118 (70 in FIG. 1). This connects the eject valve solenoid 122 and the ejector check valve solenoid 120 across the AC line and allows hydraulic cylinder 74 to operate. However, before it can do so, the hydraulic pump motor 110 must be energized. This is accomplished via closure of the contacts 130 on the ejector switch 118 which causes line voltage to appear at junction point 138. Since at this time, the relay CR2 is de-energized, the normally closed contacts 156 will be closed and the motor control relay 158 will be energized. The remainder of the system remains inoperative however, since the relay winding CR1 remains de-energized.

It was initially assumed that the cycle-selector switch 172 was toggled to its automatic position. When the cycle-selector switch 172 is in its manual position, the time delay relay 182 and associated lamp 186 are no longer energized and, hence, inoperative to effect automatic operation. Manual operation is achieved by depressing the cycle-start switch 146 which serves to connect the relay winding CR1 between the ground bus 126 and the power bus 144. The sequence which follows is identical in all respects to the operation obtained when the light beam is broken for a predetermined period when the system is in its automatic mode.

This completes an explanation of the operation of the compactor device of the present invention.

It can be seen that there is provided by this invention an improved arrangement of hydraulic actuators and controls within a trash compacting device which permits significant improvement over prior art designs. While there has been illustrated and explained a preferred embodiment of the invention, it is to be understood that various changes and modifications may be made thereto without departing from the spirit and scope of the invention as set forth in the following claims.

I claim:

1. A waste compacting apparatus comprising in combination:

a. an enclosure defining first and second chambers, said first chamber having an open top through which waste material to be compacted may pass, four side walls and a horizontally movable floor member;

b. said second chamber in communication with said first chamber and being disposed at least in part vertically beneath said first chamber, with said horizontally movable floor member defining a communicating port with said first chamber and closing said port when said horizontally movable floor member is in a first position, a horizontally retractable side plate connected to said horizontally movable floor member and a bottom and three additional side members connected together to define a rectangular compartment;

c. a third chamber having four sides, a top and a bottom, one of said sides having an opening which is closed by said horizontally retractable side plate when said horizontally movable floor member is in said first position, said top of said third chamber being vertically movable, one other side of said chamber including a latchable access door communicating therewith;

d. a first hydraulic actuator disposed in said second chamber and connected to said horizontally retractable side plate;

e. a second hydraulic actuator connected to said top of said third chamber;

f. control means connected to said first hydraulic actuator which when activated causes said first hydraulic actuator to become operative to move said horizontally movable floor member and said side plate to a second position whereby the waste material falls through said port in said top of said second chamber and to subsequently move said horizontally movable floor member and said side plate back to said first position whereby said waste material is pushed by said side plate through said opening in said third chamber;

g. further control means connected to said second hydraulic actuator which when activated causes said second hydraulic cylinder to become operative to move said top of said third chamber vertically downward to apply compressive force to said waste material and to subsequently move said top of said third chamber vertically upward to its rest position;

h. a photo-electric sensor is disposed in said first chamber for activating said control means when the waste material in said first chamber reaches a predetermined level; and i. a third hydraulic actuator having a piston oriented in a horizontal plane and passing through the side of said third chamber opposite to said other side including said access door, and manually actuatable control means associated with said third hydraulic cylinder for causing the compacted waste to be pushed horizontally outwardly from said third chamber by way of said access door, said manually actuatable control means including interlock means for preventing actuation of said third hydraulic actuator when said access door is in its latched position.

* * * * *